US006361242B1

(12) United States Patent
Daoud

(10) Patent No.: US 6,361,242 B1
(45) Date of Patent: Mar. 26, 2002

(54) CONNECTOR SECURITY LATCHING MECHANISM

(75) Inventor: Bassel Hage Daoud, Morris County, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/515,402

(22) Filed: Feb. 29, 2000

(51) Int. Cl.[7] ..... B25B 3/18

(52) U.S. Cl. ..... 403/329; 403/321; 403/326; 379/399; 439/557; 439/565

(58) Field of Search ..... 379/399, 445; 439/549, 557, 562, 565, 567, 575; 403/321, 322.1, 322.3, 322.4, 325, 326, 327, 329, 315, 316, 19

(56) References Cited

U.S. PATENT DOCUMENTS 4,825,466 A * 4/1989 Dowler et al. ..... 379/399
5,074,807 A * 12/1991 Parmer ..... 439/557
5,328,288 A * 7/1994 Masuda ..... 403/329
5,497,416 A * 3/1996 Butler, III et al. ..... 379/399
5,529,426 A * 6/1996 Masuda et al. ..... 403/329
5,892,659 A * 4/1999 Cooper et al. ..... 361/727

* cited by examiner

*Primary Examiner*—Lynne H. Browne
*Assistant Examiner*—Aaron Dunwoody

(57) ABSTRACT

A connector security latching mechanism for enabling the quick and easy mounting of a connector includes a connector bracket for positioning at least one connector. The connector bracket includes a first end and a second end. A housing bracket for receiving the connector bracket in a predetermined orientation. The housing bracket includes a first end and a second end. A latching mechanism is provided on at least one of the first end and the second end of the connector bracket for enabling a latch to normally engage and lock with at least one of the first end and the second end of the housing bracket. A tool is provided for permitting the disconnection of the latching mechanism from the housing bracket. The tool permits authorized personnel to disengage the latching mechanism for removal of the connector bracket from the housing bracket.

15 Claims, 5 Drawing Sheets

CONNECTOR SECURITY LATCHING MECHANISM

BACKGROUND OF THE INVENTION

1. Field of the Invention

A connector security latching mechanism that enables the quick and easy mounting of a connector onto a housing. The latching mechanism is designed to permit the disconnection of a latch from the housing by means of a tool that is provided to authorized personnel. The latching mechanism is provided on a side of the connector for enabling a disengaging bracket to engage a side of the connector to permit only a technician with a specially designed disengaging bracket to remove the latching mechanism. The tool includes a built in side latch to prevent the tool from falling away during removal.

2. Description of Background Art

Hiterto fore, individuals could disconnect a connector from a housing by using conventional tools. This permitted the unauthorized disassembly of a of a connector from the housing by unauthorized personnel. This unauthorized disassembly is a breach of the security of the connector.

SUMMARY AND OBJECTS OF THE INVENTION

The present invention is provided to enable only authorized personnel to quickly and easily disassemble a connector from a housing with the use of a specially designed tool. The specially designed tool enables the disengagement of a latch on the connector that secures the connector to the housing. The tool includes a surface for engagement with an inclined surface of the latch for displacing the latch relative to an engaging aperture in the housing as the tool is displaced downwardly into engagement with the inclined surface of the latch.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
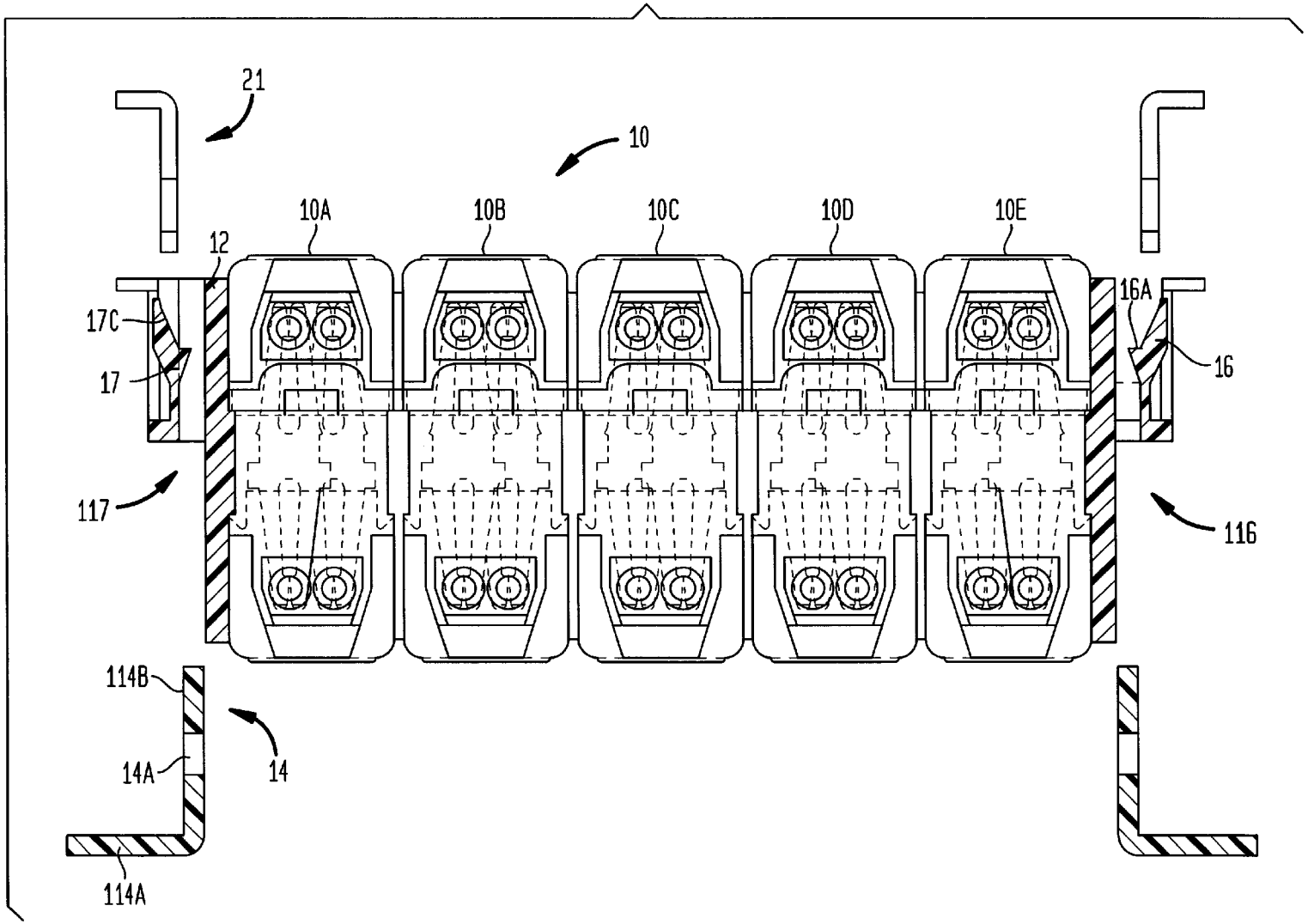
FIG. 1 is an exploded side cross-sectional view of a plurality of connectors including latches positioned at side portions thereof, the latches are designed to be received within openings in housing brackets, a tool is disposed above the latches and is designed for enabling the latches to be disengaged from the openings in the housing bracket.

As illustrated in FIGS. 1–4, a connector security latching mechanism 10 includes a plurality of connectors 10A, 10B, 10C, 10D and 10E that are mounted on a connector bracket 12. The connector bracket 12 should be mounted relative to a housing bracket 14 to enable the quick and easy mounting of the connector bracket 12 onto the housing bracket 14. The latching mechanism 10 is designed to permit the disconnection of a latch 16 from the housing bracket 14 by means of a tool 21. The tool 21 is only issued to authorized personnel to enable authorized personnel to disconnect the latch 16 from the housing bracket 14. The latch 16 is provided on a first side 116 of the connector bracket 12. The latch 17 is provided on a second side 117 of the connector bracket 12. The tool 21 is designed to individually engage the latches 16, 17 to disconnect the latches from the housing bracket 14.

As illustrated in FIGS. 5–9, the housing bracket 14 may be formed of sheet metal and includes a lower frame member 114A with an upwardly projecting frame member 114B. The upwardly projecting frame member 114B includes an aperture 14A for receiving a projection 16A, 17A of the respective latches 16, 17.

The construction of the latch 16 will be described with reference to FIGS. 5–8. It is to be understood that the latch 17 has a similar construction to the latch 16. A detailed description of the construction of the latch 17 will be omitted. The projection 16A of the latch 16 extends from a first side thereof. An upper portion 16B includes an inclined surface 16C that is spaced by a distance "d" from the housing bracket wall portion 114C. The inclined surface 16C is designed to be engaged with a notch 210 in the tool 21. A lower portion 16D is secured to a support portion 16E. The lower portion 16D can be biased by the notch 210 of the tool 21 to displace the projection 16A relative to the aperture 14A and thereby release the latch 16 from the housing bracket 14.

Figure 6:
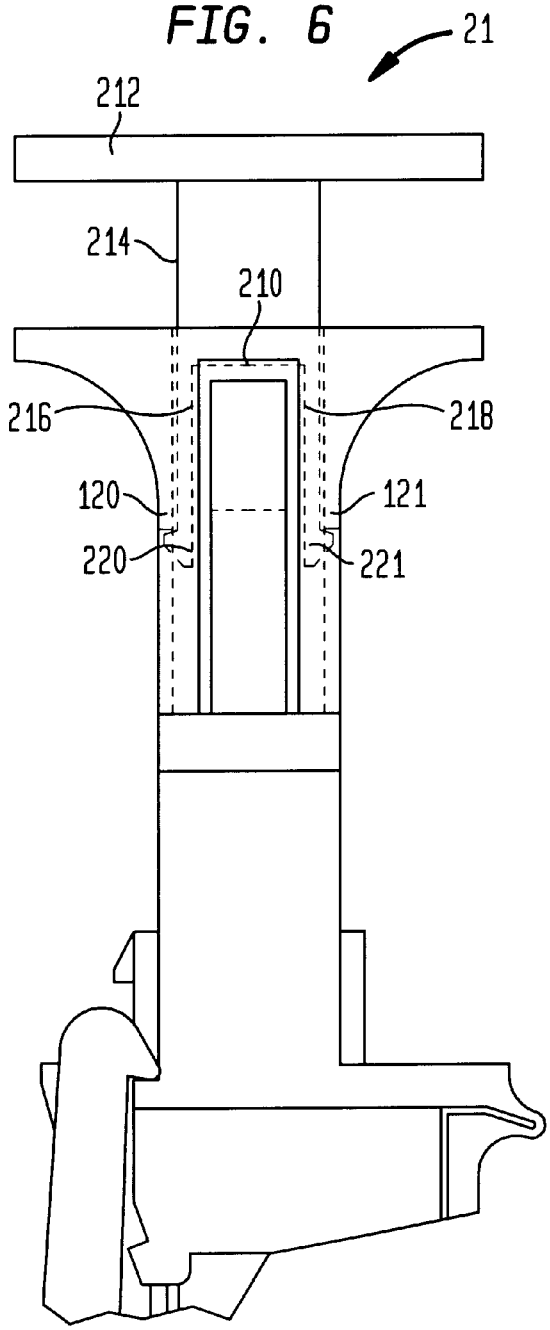
FIG. 6 is a side cross-sectional view of one latch engaged in an opening in the housing bracket and illustrating a disengaging tool disposed above the latch just prior to engagement therewith.
Figure 8:
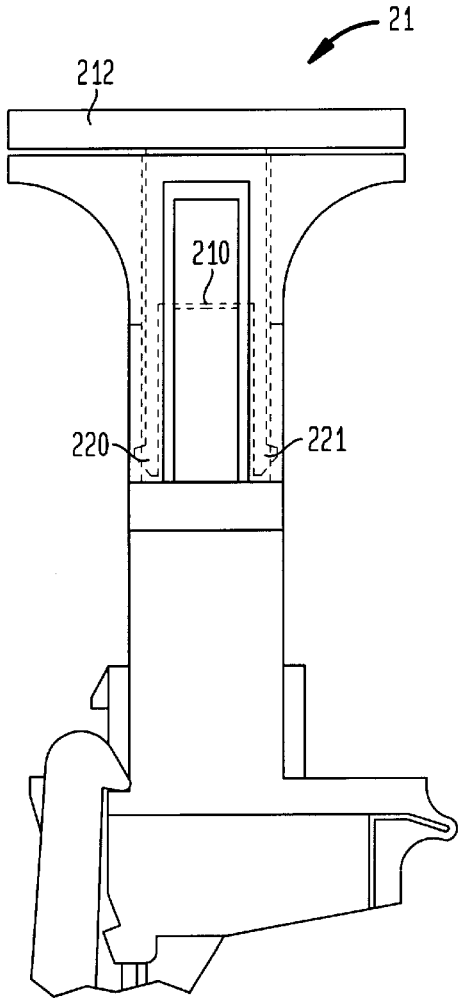
FIG. 8 is a side cross-sectional view of one latch and illustrating a disengaging tool in engagement with the latch for disengaging the latch from the opening in the housing bracket.
Figure 9:
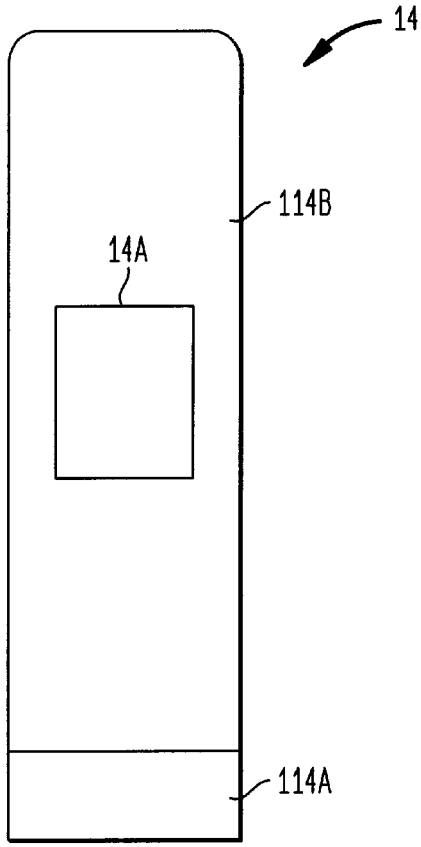
FIG. 9 is an enlarged front view of the housing bracket illustrating an aperture in the housing bracket for mating with the latch.

As illustrated in FIGS. 6 and 8, the tool 21 includes a handle portion 212 that is bent relative to a main engagement portion 214. The main engagement portion 214 includes downwardly projecting members 216, 218 that extend below the notch 210. Distal ends of the downwardly projecting members 216, 218 include projections 220, 221. The tool 21 is self latching onto the connector bracket 12 to be able to slide up and down relative thereto. The projections 220, 221 can engage with the portions 120, 121, respectively, for permitting authorized personnel to engage the connector bracket 12 with the tool 21 for effecting a disconnection of the latches 16, 17 from the housing bracket 14 to permit the removal of the connector bracket 12 from the housing bracket 14. This prevents the tool 21 from falling off away from the connector bracket 12 during removal.

Figure 2:
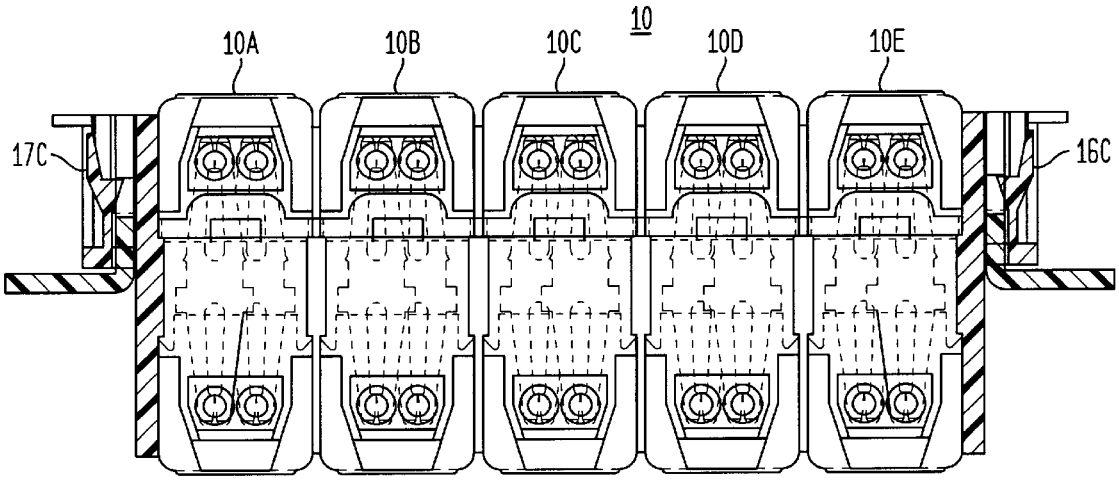
FIG. 2 is a cross-sectional view illustrating the latches in engagement with the openings in the housing bracket.

Referring to FIGS. 2–8, the operation of the tool 21 relative to the latches 16, 17 and the housing bracket 14 will be discussed. As illustrated in FIG. 2, the latches 16, 17 are in engagement within apertures in the housing bracket 14 for securely mounting the connector bracket 12 relative to the housing bracket 14. The connectors 10A, 10B, 10C, 10D and 10E are mounted on the housing bracket 14 for providing necessary electrical connections.

Figure 3:
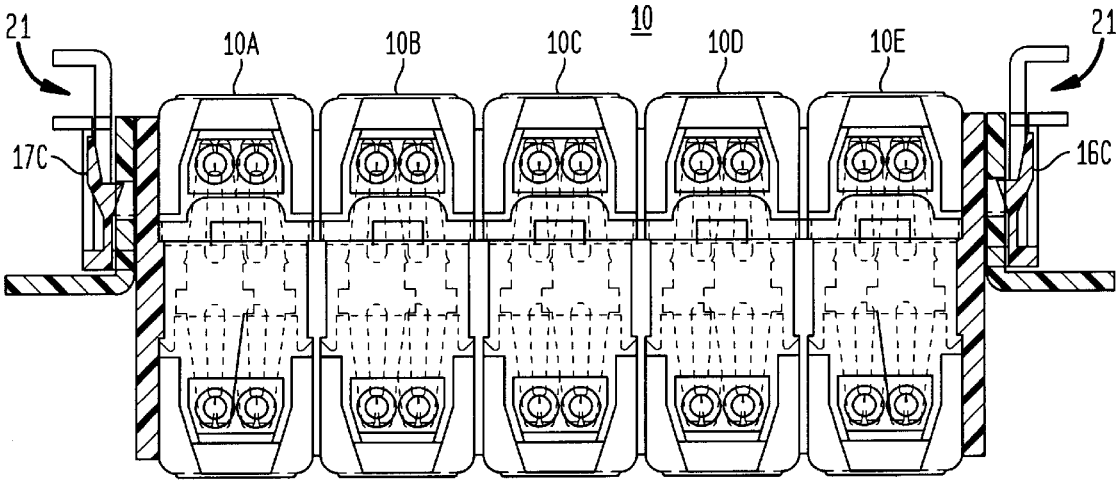
FIG. 3 is a cross-sectional view illustrating the disengaging tools being disposed above the latches just prior to engagement therewith.
Figure 5:
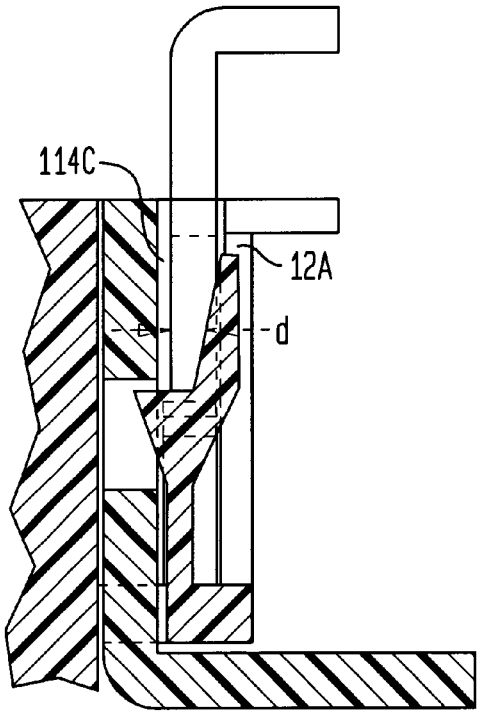
FIG. 5 is a cross-sectional view of one latch engaged in an opening in the housing bracket and illustrating a disengaging tool disposed above the latch just prior to engagement therewith.

As illustrated in FIGS. 3, 5 and 6, the tool 21 is initially positioned above the latches 16, 17 and within a space formed between the housing bracket 14 and an exterior portion 12A of the connector bracket 12. The projections 220, 221 engage with the portions 120, 121, respectively, of the connector bracket 12 for preventing the tool 21 from falling off away from the connector bracket 12 during removal.

Figure 4:
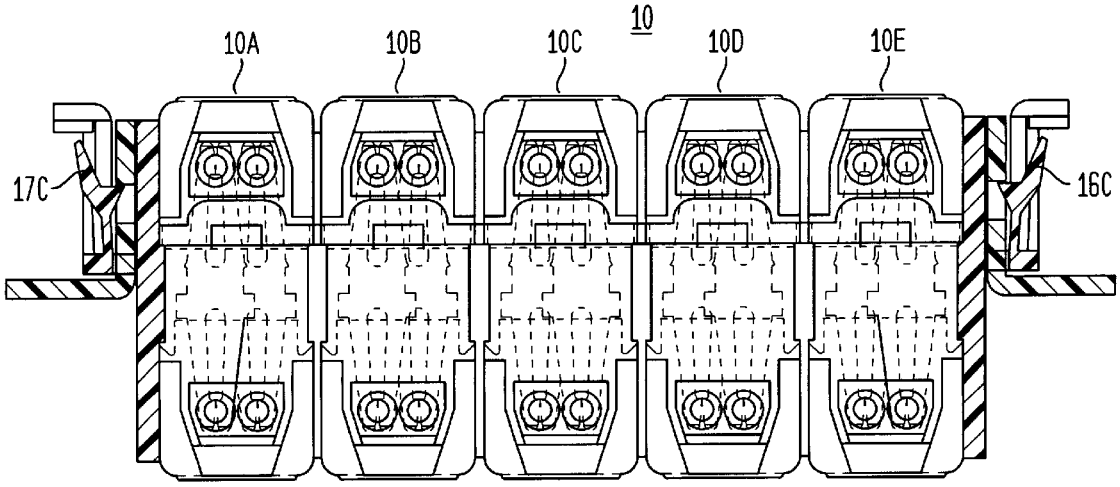
FIG. 4 is a cross-sectional view illustrating the disengaging tools being in engagement with the latches for disengaging the latches from the openings in the housing bracket.
Figure 7:
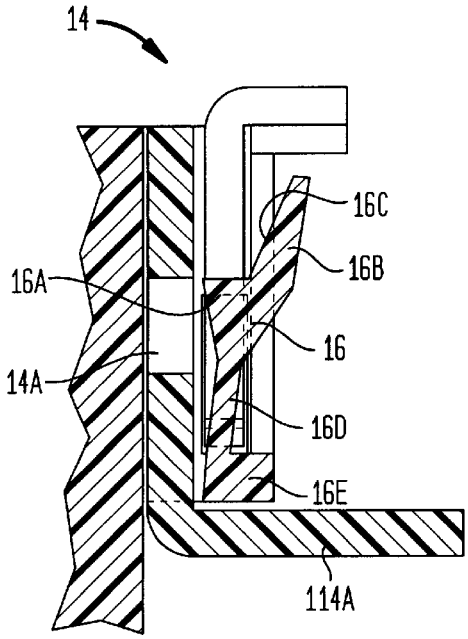
FIG. 7 is a cross-sectional view of one latch and illustrating a disengaging tool in engagement with the latch for disengaging the latch from the opening in the housing bracket.

As illustrated in FIGS. 4, 7 and 8, the tool 21 is manually inserted within the space formed between the housing bracket 14 and an exterior portion 12A of the connector bracket 12 for permitting the notch 210 of the tool 21 to engage the inclined surfaces 16C, 17C of the latches 16 and 17. Referring to FIGS. 7 and 8, as the tool 21 extends within the space formed between the housing bracket 14 and the exterior portion 12A of the connector bracket 12, the lower portion 16D is biased by the notch 210 of the tool 21 to displace the projection 16A relative to the aperture 14A and thereby release the latch 16 from the housing bracket 14. A similar operation of the latch 17 relative to the housing bracket 14 occurs on the opposite side of the connector bracket 12. Displacing the latches 16 and 17 so that they do not engage within the aperture 14A of the housing bracket 14 permits the connector bracket 12 to be removed from the housing bracket 14.

The present invention enables authorized personnel to utilize the tool 21 to permit the connector bracket 12 to be removed from the housing bracket 14 for servicing or replacement. Unauthorized individuals are not permitted to tamper with the disconnection of the connector bracket 12 from the housing bracket 14.

Figure 10:
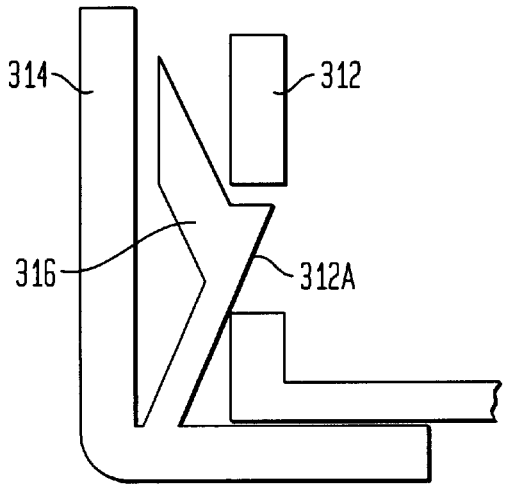
FIG. 10 is a view of an embodiment of the present invention wherein the latch mechanism is mounted on the housing bracket and an aperture is provided in the connector bracket for mounting the housing bracket and connector bracket relative to each other.

FIG. 10 is a view of an embodiment of the present invention wherein the latch mechanism 316 is mounted on the housing bracket 314 and an aperture 312A is provided in the connector bracket 312 for mounting the housing bracket 314 and connector bracket 312 relative to each other.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A connector security latching mechanism for enabling the quick and easy mounting of a connector comprising:

a connector bracket adapted for positioning at least one connector, said connector bracket including a first end and a second end;

a housing bracket for receiving said connector bracket in a predetermined orientation, said housing bracket including a first end and a second end;

a latching mechanism provided on at least one of the first end and the second end of the connector bracket for enabling a latch to normally engage and lock with at least one of the first end and the second end of the housing bracket; and a tool for permitting the disconnection of the latching mechanism from the housing bracket, said tool permitting authorized personnel to disengage the latching mechanism for removal of the connector bracket from the housing bracket, wherein the tool latches onto the connector bracket to prevent the tool from falling away from the connector bracket as the connector bracket is removed from the housing bracket.

2. The connector security latching mechanism for enabling the quick and easy mounting of a connector according to claim 1, wherein said latching mechanism is provided on said first end of said connector bracket for enabling the latch to normally engage and lock with the first end of the housing bracket and said latching mechanism is provided on said second end of said connector bracket for enabling the latch to normally engage and lock with the second end of the housing bracket.

3. The connector security latching mechanism for enabling the quick and easy mounting of a connector according to claim 1, wherein said housing bracket includes an upwardly projecting frame member with an aperture disposed therein for mating with the latch mechanism.

4. The connector security latching mechanism for enabling the quick and easy mounting of a connector according to claim 1, wherein the latch mechanism is a latch including a projection extending from one side thereof for engaging and locking with said housing bracket.

5. The connector security latching mechanism for enabling the quick and easy mounting of a connector according to claim 4, wherein said latch includes an inclined surface for engagement with said tool for biasing said latch away from said housing bracket to permit disengagement therefrom.

6. The connector security latching mechanism for enabling the quick and easy mounting of a connector according to claim 4, wherein said latch includes an inclined surface for engagement with said tool and a lower portion that is biased away from the housing bracket when said tool engages the inclined surface.

7. The connector security latching mechanism for enabling the quick and easy mounting of a connector according to claim 1, wherein said tool includes a main engagement portion and downwardly projecting members extending therefrom, the downwardly projecting members include projections extending therefrom for latching engagement with the connector bracket to prevent the tool from falling off away from the connector bracket during removal of the connector bracket from the housing bracket.

8. The connector security latching mechanism for enabling the quick and easy mounting of a connector according to claim 1, wherein the connector bracket is moved in a first direction toward said housing bracket when the connector bracket is attached to the housing bracket and moved in a second opposite direction when the connector bracket is removed from the housing bracket, and wherein the tool is inserted into the connector bracket in the first direction to disconnect the connector bracket from the housing bracket.

9. A connector security latching mechanism for enabling the quick and easy mounting of a connector comprising:

a connector bracket adapted for positioning at least one connector, said connector bracket including a first end and a second end;

a housing bracket for receiving said connector bracket in a predetermined orientation, said housing bracket including a first end and a second end;

a latching mechanism provided on at least one of the first end and the second end of the connector bracket for enabling a latch to normally engage and lock with at least one of the first end and the second end of the housing bracket; and a tool for permitting the disconnection of the latching mechanism from the housing bracket, said tool permitting authorized personnel to disengage the latching mechanism for removal of the connector bracket from the housing bracket, wherein the connector bracket is moved in a first direction toward said housing bracket when the connector bracket is attached to the housing bracket and moved in a second opposite direction when the connector bracket is removed from the housing bracket, and wherein the tool is inserted into the connector bracket in the first direction to disconnect the connector bracket from the housing bracket.

10. The connector security latching mechanism for enabling the quick and easy mounting of a connector according to claim 9, wherein said latching mechanism is provided on said first end of said connector bracket for enabling the latch to normally engage and lock with the first end of the housing bracket and said latching mechanism is provided on said second end of said connector bracket for enabling the latch to normally engage and lock with the second end of the housing bracket.

11. The connector security latching mechanism for enabling the quick and easy mounting of a connector according to claim 9, wherein said housing bracket includes an upwardly projecting frame member with an aperture disposed therein for mating with the latch mechanism.

12. The connector security latching mechanism for enabling the quick and easy mounting of a connector according to claim 9, wherein the latch mechanism is a latch including a projection extending from one side thereof for engaging and locking with said housing bracket.

13. The connector security latching mechanism for enabling the quick and easy mounting of a connector according to claim 12, wherein said latch includes an inclined surface for engagement with said tool for biasing said latch away from said housing bracket to permit disengagement therefrom.

14. The connector security latching mechanism for enabling the quick and easy mounting of a connector according to claim 12, wherein said latch includes an inclined surface for engagement with said tool and a lower portion that is biased away from the housing bracket when said tool engages the inclined surface.

15. The connector security latching mechanism for enabling the quick and easy mounting of a connector according to claim 12, wherein said tool includes a main engagement portion and downwardly projecting members extending therefrom, the downwardly projecting members include projections extending therefrom for latching engagement with the connector bracket to prevent the tool from falling off away from the connector bracket during removal of the connector bracket from the housing bracket.

* * * * *